United States Patent [19]

Jones, Jr.

[11] Patent Number: 4,506,538

[45] Date of Patent: Mar. 26, 1985

[54] PUNCH-CLAMPING CONSTRUCTION FOR PRESSES

[75] Inventor: Clarence O. Jones, Jr., Buffalo, N.Y.

[73] Assignee: Niagara Machine & Tool Works, Buffalo, N.Y.

[21] Appl. No.: 534,481

[22] Filed: Sep. 21, 1983

[51] Int. Cl.[3] ..... B21D 37/04

[52] U.S. Cl. ..... 72/481; 72/389; 72/462; 403/373; 403/341; 403/384

[58] Field of Search ..... 72/389, 481, 482, 462, 72/475, 386; 403/373, 341, 384, 16; 100/903; 296/157, 170, 162

[56] References Cited

U.S. PATENT DOCUMENTS 1,465,042 8/1923 Hruska ..... 403/373
4,315,425 2/1982 Zbornik et al. ..... 72/481

FOREIGN PATENT DOCUMENTS 2315025 1/1977 France ..... 403/373
2427148 2/1980 France ..... 72/481

*Primary Examiner*—Daniel C. Crane
*Assistant Examiner*—David B. Jones
*Attorney, Agent, or Firm*—Joseph P. Gastel

[57] ABSTRACT

A clamp construction for mounting an elongated punch on a ram of a press including a plurality of rocker arms pivotally mounted on the ram, a plurality of spring units bearing against upper ends of the rocker arms, a movable jaw on the ram in opposition to a fixed jaw, the lower ends of the rocker arms pressing the movable jaw toward the fixed jaw to hold a punch therebetween, and a plurality of hydraulic motor units spacedly mounted lengthwise on the ram for counteracting the force exerted by the rocker arms on the movable jaw to thereby effect the release of the punch held between the fixed and movable jaws.

8 Claims, 8 Drawing Figures

PUNCH-CLAMPING CONSTRUCTION FOR PRESSES

BACKGROUND OF THE INVENTION

The present invention relates to a spring clamping construction for securing a punch on the ram of a press and a hydraulic motor construction which selectively counteracts the spring force to permit the rapid removal and installation of punches.

By way of background, the normal way of holding an elongated punch on the ram of a press is by a plurality of screws which are spaced lengthwise of an elongated movable jaw, each of which must be loosened and tightened manually to move the movable jaw toward and away from a fixed jaw which cooperates with the movable jaw to hold a punch therebetween. The manual tightening and loosening of the screws is time-consuming, and when it is considered that punches may require changing many times a day, the foregoing structure causes the press to be out of operation for relatively long periods, thereby reducing its productivity. In other types of prior art presses, the movable jaw is held in locking engagement relative to the fixed jaw by hydraulic pressure which must be exerted on the movable jaw at all times to maintain the locking engagement. It is with obviating the foregoing deficiencies of prior punch clamping structure of presses that the present invention is concerned.

SUMMARY OF THE INVENTION

It is one object of the present invention to provide an improved punch-clamping structure for a press which permits the punch to be removed and replaced rapidly.

Another object of the present invention is to provide an improved punch-clamping mechanism for a press which not only achieves the foregoing object, but also holds the punch by a plurality of independent spring units.

A further object of the present invention is to provide an improved punch-clamping construction for a press which utilizes hydraulic pressure to override the mechanical gripping force which holds the punch in position to thereby selectively open the clamping jaws to permit a punch to be removed and replaced. Other objects and attendant advantages of the present invention will readily be perceived hereafter.

The present invention relates to a clamp construction for mounting a punch on the ram of a press comprising an elongated ram, an elongated stationary jaw on said elongated ram, a first punch gripping portion on said elongated stationary jaw, an elongated movable jaw, mounting means on said elongated movable jaw for movably mounting said elongated movable jaw on said elongated ram, a second punch gripping portion on said elongated movable jaw in opposition to said first punch gripping portion for mounting a punch therebetween, a plurality of spring means spaced lengthwise of said elongated ram, coupling means for coupling said plurality of spring means to said elongated movable jaw for biasing said elongated movable jaw toward said elongated fixed jaw, and motor means mounted on said elongated ram for moving said elongated movable jaw away from said fixed jaw in opposition to the force exerted by said spring means.

The various aspects of the present invention will be more fully understood when the following portions of the specification are read in conjunction with the accompanying drawings wherein:

DESCRIPTION OF THE PREFERRED EMBODIMENTS

Figure 1:
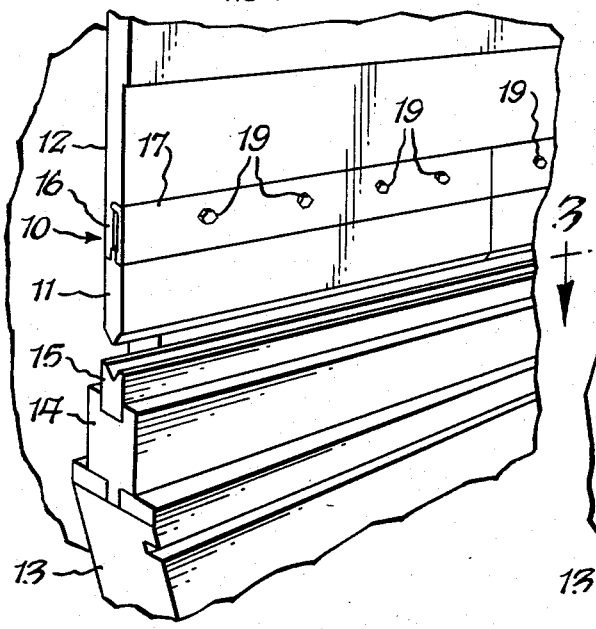
Fig. 1. PRIOR ART
FIG. 1 is a fragmentary perspective view of a press having a prior art punch clamping construction on the ram thereof.

The improved punch mounting structure for a press permits the punch to be installed on and removed from the ram of a press in an extremely simple and rapid manner. This can be more fully appreciated when the improved mounting structure of the present invention is compared to the prior art punch mounting construction 10 of FIG. 1 wherein punch 11 is mounted on ram 12 of press 13 having a base 14 on which die 15 is secured. The prior art ram 12 includes a fixed jaw 16 and a movable jaw 17 which is mounted on the ram by a plurality of screws 19 spaced lengthwise of ram 12. Every time the punch 11 has to be removed from press 13, which may be ten to twelve times per day, each of the screws 19 must be loosened by hand to permit movable jaw 17 to pivot away from fixed jaw 16 to thereby release punch 11. After the new punch has been installed between jaws 16 and 17, each of the screws 19 has to be tightened by hand. This obviously is a time-consuming procedure which subtracts from the time that the punch can be in operation. The manner in which movable jaw 17 is pivotally mounted on ram 12 has not been changed by the structure of the present invention, and this mounting will be explained hereafter with reference to the improved punch clamping structure.

Figure 2:
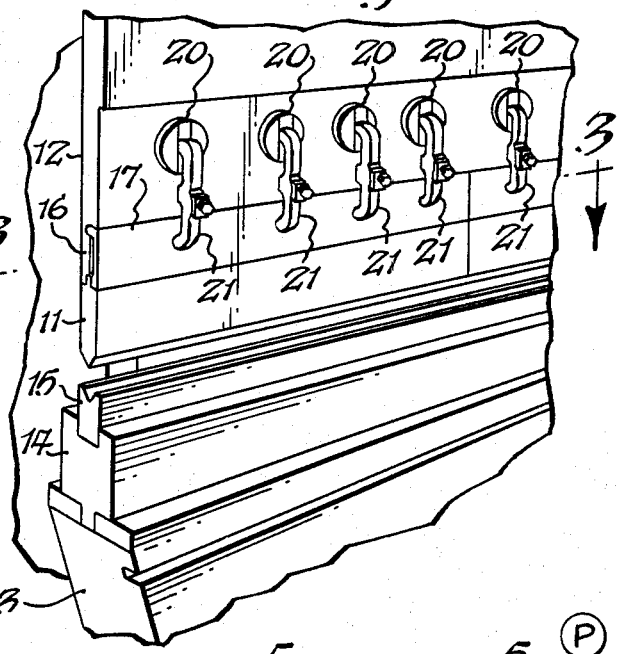
FIG. 2 is a fragmentary perspective view of a press having the improved punch clamping construction of the present invention on the ram thereof.
Figure 3:
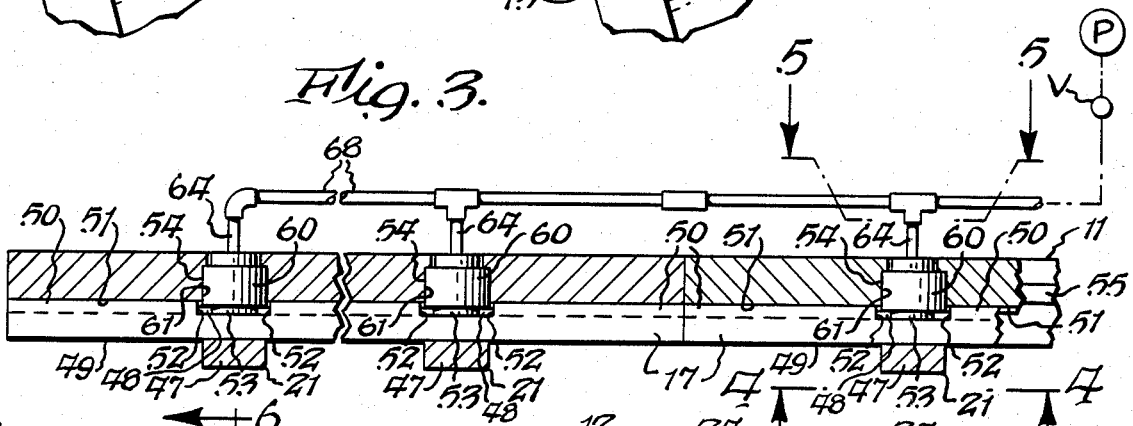
FIG. 3 is a fragmentary cross sectional view taken substantially along line 3—3 of FIG. 2 and showing the hydraulic motor structure and circuit for moving the movable jaw of the ram away from the fixed jaw to thereby release the punch held therebetween.
Figure 4:
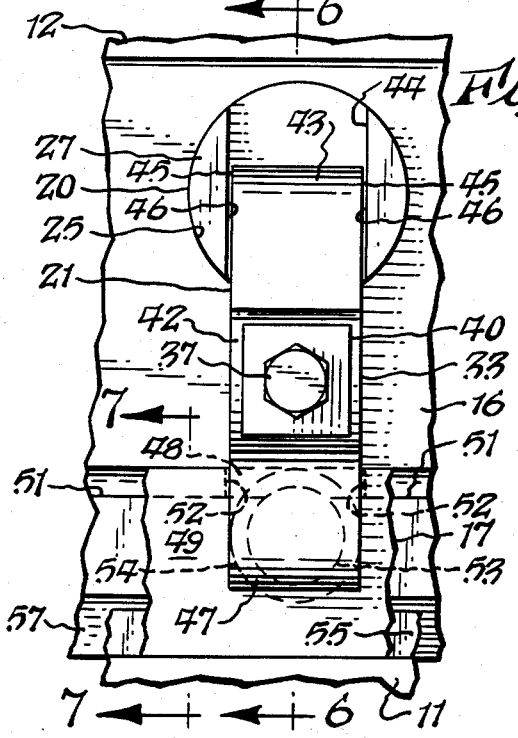
FIG. 4 is a fragmentary enlarged front elevational view showing the lower portion of the ram mounting the rocker arm and also showing its relationship to the fixed spring and the movable jaw.
Figure 5:
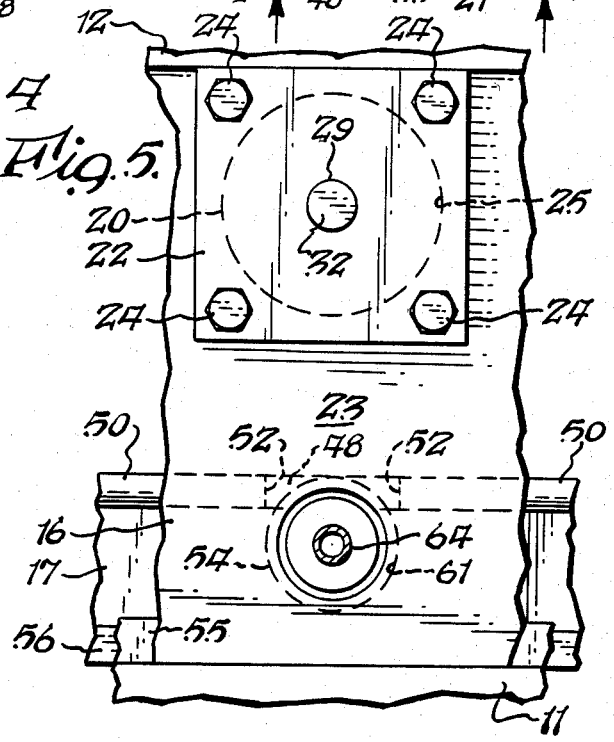
FIG. 5 is a fragmentary front elevational view of the plate mounted on the rear of the lower portion of the ram for containing a spring structure therein.
Figure 6:
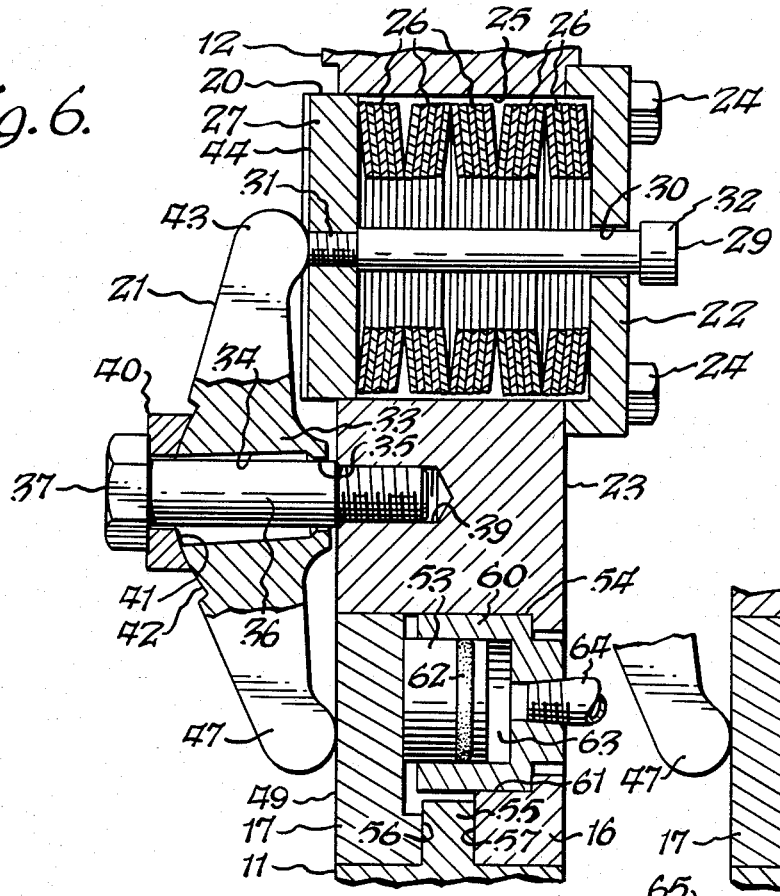
FIG. 6 is a fragmentary enlarged cross sectional view, partially broken away, taken substantially along line 6—6 of FIG. 4 and showing the operative portions of the clamping structure in relation to each other.

Relative to the improved clamping structure, press 13 of FIG. 2 mounts ram 12 which also carries punch 11 which is held between fixed jaw 16 and movable jaw 17. However, the improved punch clamping structure of the present invention has eliminated screws 19 and instead uses a plurality of spring units 20 spaced lengthwise of elongated ram 12 for bearing on rocker arms 21 which in turn bear against movable jaw 17 to clamp punch 11 between it and fixed jaw 16. The improved clamping construction, in its more specific aspects includes spring units 20, each of which includes a back plate 22 (FIGS. 5 and 6) which is secured to the rear surface 23 of ram 12 by a plurality of screws 24. Back plate 22 is mounted at the end of cylindrical bore 25 which houses a plurality of axially spaced Bellville spring units 26 which are oriented as shown in FIG. 6. Each of the spring units 26 consists of five separate springs. A disc-like face plate 27 in the nature of a piston is axially slidable in bore 25. A screw 29 slidably extends through bore 30 in back plate 22 and is threadably attached to face plate 27 at 31. Head 32 of screw 29 limits the amount which face plate 27 can move to the left in FIG. 6 under the urging of the spring units 26.

The force exerted by spring units 26 on each face plate 27 is transferred to movable jaw 17 through each of the rocker arms 21. In this respect, the central portion 33 of each rocker arm has a relatively large bore 34 therein which terminates at an annular flange 35 which is only slightly larger than the diameter of shank 36 of bolt 37 which is threadably received in bore 39 of ram 12. A washer 40 has a cylindrical surface 41 which is in complementary mating engagement with cylindrical surface 42 of rocker arm 21. A suitable lubricant is provided therebetween. Thus, rocker arm 21 can pivot about flange 35. The upper end portion 43 of each rocker arm 21 is received in each slot 44 of face plate 27 and is prevented from moving either clockwise or counterclockwise about the axis of screw 37 because the sides 45 of the rocker arm are in substantial abutting engagement with the sides 46 of slot 44. The lower outer end 47 of rocker arm 21 bears against the outer surface 49 of movable jaw 17 which has a lip 50 which is received in groove 51 of ram 12. Thus, movable jaw 17 can pivot as lip 50 pivots in groove 51. Lip 50 extends throughout the length of movable jaw 17, except where it is cut away at 48 with the lip 50 terminating at edges 52 to provide clearance for the piston 53 of each hydraulic motor 54, as described hereafter.

The parameters of the foregoing construction are such that when the gripping portion or flange 55 of punch 11 is secured between the gripping surface 56 of movable jaw 17 and the gripping surface 57 of stationary jaw 16, the full force of spring units 26 of each spring unit 20 will be transmitted through face plate 27 to each rocker arm 21 and then to movable jaw 17. It can be seen from FIG. 6 that this is possible because head 32 of screw 29 is spaced from back plate 22. It is contemplated that each spring unit 20 will exert approximately 3,000 pounds of force onto surface 49 of movable jaw 17.

Figure 7:
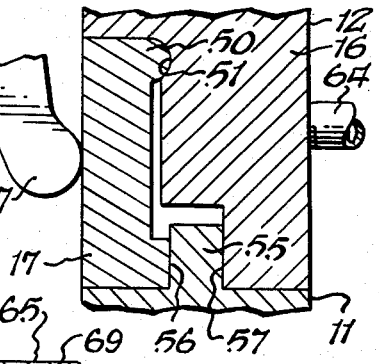
FIG. 7 is an enlarged fragmentary cross sectional view taken substantially along line 7—7 of FIG. 4 and showing the structure for mounting the movable jaw on the ram.

When punch 11 is to be released from between jaws 17 and 59, a plurality of hydraulic motor units 54 are actuated simultaneously to cause jaw 17 to pivot in a clockwise direction about surface 51 (FIG. 7). In this respect, each hydraulic motor unit 54 comprises a cylindrical housing 60 which is located in bore 61 of ram 12 above gripping surface 57 of fixed jaw 16. A piston 53 having an O-ring 62 thereon is axially movable in housing 60. A chamber 63 receives hydraulic fluid from conduit 64 which is coupled by suitable fittings to main hydraulic line 68 which receives hydraulic fluid from a suitable pump P whenever valve V is actuated. Thus, when hydraulic fluid is pumped into chamber 63 of each of the motors 54, pistons 53 will be moved to the left in FIG. 6 to thereby cause movable jaw 17 to pivot in a clockwise direction and thus also cause each of the rocker arms 21 to pivot in a clockwise direction in FIG. 6 against the bias of spring units 20. As gripping surface 56 moves away from gripping surface 57, the punch 11, which has been moved downwardly with the ram to rest in die 15, is no longer gripped, and ram 12 can be lifted away from punch 11. Thereafter a different punch is slid into resting relationship with die 15, and ram 12 is lowered until the gripping portion or flange 55 of die punch 11 is located between gripping surfaces 56 and 57, whereupon the hydraulic pressure in line 68 is released to thereby permit spring units 20 to expand and pivot each of the rocker arms 21 in a counterclockwise direction in FIG. 6 so that movable jaw 17 is moved to cause portion 55 of punch 11 to be clamped between the movable and fixed jaws of the ram.

Figure 8:
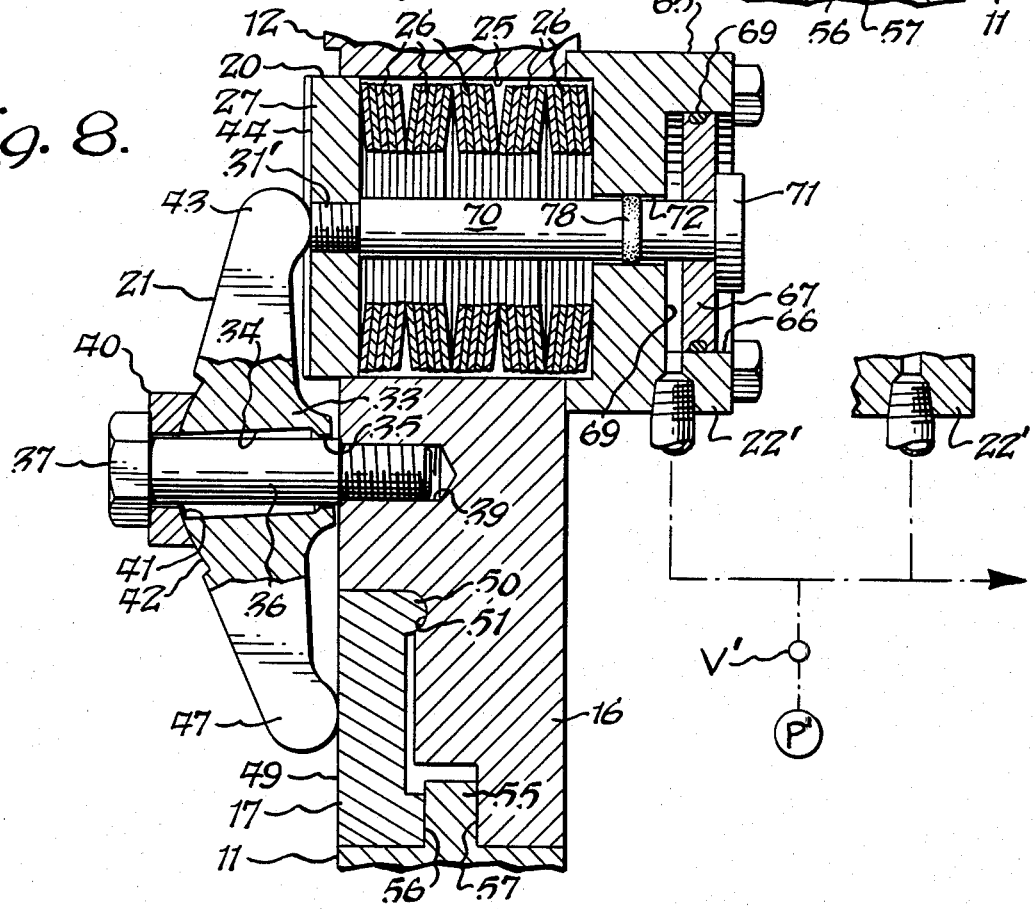
FIG. 8 is a view similar to FIG. 6 but showing a modified form of hydraulic motor for selectively releasing the movable jaw.

A modified embodiment of the present invention is disclosed in FIG. 8 wherein the only difference is that each hydraulic motor 65 is formed as part of back plate 22' which is analogous to back plate 22 of FIG. 6 and which performs the same function relative to spring units 26. The remainder of the structure, except for back plate 22', is identical to the structure shown in FIG. 6 except that there are no hydraulic motors 54 in the area of the jaws and further, lip 50 of movable jaw 17 is continuous because there has been no necessity to cut it away at 52 to accommodate hydraulic motors 54. Therefore, all parts of FIG. 8 which bear the same numerals as those of the preceding figures are identical to the preceding figures and need not be described again in detail. Those numerals which are primed depict structure which is analogous to structure of the preceding figures.

In the embodiment of FIG. 8, back plate 22' includes a bore 66 into which disc-like piston 67 is mounted for axial movement, an O-ring 69 providing sealing between the outer edge of piston 67 and bore 66. A chamber 69 is located as shown. A piston rod 70 has its head 71 secured to piston 67 in a fluid-tight manner, and an O-ring 78 encircles piston rod 70 so that it can slide within bore 72 without leakage of hydraulic fluid in chamber 69. The end of piston rod 70 is secured to face plate 27 by a threaded connection at 31'. It can thus be seen that when the hydraulic pressure in chamber 69 of each motor 65 is low, each spring unit 20 will expand to move face plate 27 to the left in FIG. 8 to pivot each rocker arm 21 in a counterclockwise direction to force movable jaw 17 into gripping engagement with portion 55 of punch 11. When it is desired to release portion 55 of punch 11, hydraulic fluid under pressure is supplied to chambers 69 which will cause piston 67 to move to the right and carry piston rod 70 with it to thereby move each face plate 27 to the right against the bias of spring units 26. This will relieve the force which the lower outer end portion 47 of rocker arm 21 exerts on movable jaw 17 to thereby permit punch 11 to be removed. The pump P' acting through valve V' supplies the pressurized hydraulic fluid to all of the chambers 69 simultaneously.

It can thus be seen that the improved punch clamping construction of the present invention permits a punch 11 to be removed extremely quickly and another punch to be installed extremely quickly, thereby reducing the down time of the press 13.

While preferred embodiments of the present invention have been disclosed, it will be appreciated that it is not limited thereto but may be otherwise embodied within the scope of the following claims.

What is claimed is:

1. A clamp construction for mounting a punch on the ram of a press comprising an elongated ram, an elongated stationary jaw on said elongated ram, a first punch gripping portion on said elongated stationary jaw, an elongated movable jaw, mounting means on said elongated movable jaw for movably mounting said elongated movable jaw on said elongated ram, a second punch gripping portion on said elongated movable jaw in opposition to said first punch gripping portion for mounting a punch therebetween, a plurality of spring means spaced lengthwise of said elongated ram, coupling means for coupling said plurality of spring means to said elongated movable jaw for biasing said elongated movable jaw toward said elongated fixed jaw, and motor means mounted on said elongated ram for moving said elongated movable jaw away from said fixed jaw in opposition to the force exerted by said spring means.

2. A clamp construction as set forth in claim 1 wherein said coupling means comprise a plurality of links.

3. A clamp construction as set forth in claim 2 wherein said mounting means comprises an elongated lip on said elongated movable jaw, said elongated lip being remote from said second gripping portion, and an elongated groove on said elongated ram for pivotally receiving said elongated lip.

4. A clamp construction as set forth in claim 2 wherein each of said links comprises a rocker arm having first and second outer end portions and a central portion therebetween, means mounting each of said rocker arms on said ram for pivotal movement about its central portion, each of said first outer end portions being biased by said spring means and each of said second outer end portions bearing against said elongated movable jaw when said rocker arm pivots about said central portion.

5. A clamp construction as set forth in claim 4 wherein said motor means comprises a plurality of hydraulic motors spaced lengthwise of said elongated ram.

6. A clamp construction as set forth in claim 5 wherein each of said hydraulic motors is located substantially in opposition to said second outer end portion of each of said rocker arms.

7. A clamp construction as set forth in claim 6 wherein each of said hydraulic motors is located substantially in opposition to said first outer end portion of each of said rocker arms.

8. A clamp construction as set forth in claim 2 wherein each of said spring means are housed within bores in said ram, and wherein each of said links comprises a rocker arm having first and second outer end portions and a central portion therebetween, means mounting each of said rocker arms on said ram for pivotal movement about its central portion, each of said first outer end portions being biased by said spring means and each of said second outer end portions bearing against said elongated movable jaw when said rocker arm pivots about said central portion.

* * * * *